US006948506B2

(12) United States Patent
Wang

(10) Patent No.: US 6,948,506 B2
(45) Date of Patent: Sep. 27, 2005

(54) UMBRELLA WITH A ROTATABLE CANOPY

(76) Inventor: Max Wang, No. 19, Ta-Yuan 13th St., Tai-Ping City, Taichung Hsien (TW)

( * ) Notice: Subject to any disclaimer, the term of this patent is extended or adjusted under 35 U.S.C. 154(b) by 0 days.

(21) Appl. No.: 10/456,327

(22) Filed: Jun. 6, 2003

(65) Prior Publication Data

US 2004/0226589 A1 Nov. 18, 2004

(51) Int. Cl.[7] ..... A45B 9/02; A45B 25/10
(52) U.S. Cl. ..... 135/28; 135/15.1
(58) Field of Search ..... 135/28, 15.1, 33.7

(56) References Cited

U.S. PATENT DOCUMENTS

| | | | | |
|---|---|---|---|---|
| 152,781 A | * | 7/1874 | Vreeland | 135/28 |
| 2,224,882 A | * | 12/1940 | Peck | 135/98 |
| 3,784,250 A | * | 1/1974 | Beeman | 297/184.1 |
| 4,962,780 A | * | 10/1990 | Engdahl et al. | 135/33.2 |
| 4,998,551 A | | 3/1991 | DeSarno | 135/20 |
| 5,020,557 A | | 6/1991 | Apple | 135/15.1 |
| 6,314,976 B1 | | 11/2001 | Clarke | 135/28 |
| 6,386,214 B1 | * | 5/2002 | Clarke | 135/20.3 |

FOREIGN PATENT DOCUMENTS

| | | |
|---|---|---|
| WO | WO 00/22951 | 4/2000 |

* cited by examiner

*Primary Examiner*—Robert Canfield
(74) *Attorney, Agent, or Firm*—Trop, Pruner & Hu, P.C.

(57) ABSTRACT

An umbrella includes a notch member aligned with an elongate stem along an axis for connection with a rib assembly, a canopy mounted on the notch member, and a runner slidably sleeved on the stem and connected to a stretcher assembly to stretch or retract the rib assembly. First and second coupling members are respectively secured to the notch member and the stem, and have coupling ends swivelable and frictionally rotatable relative to each other about the axis. A retaining member is disposed to prevent relative displacement of the coupling ends along the axis. As such, the canopy can be forced to rotate relative to the stem about the axis once subjected to a relatively strong external force.

15 Claims, 12 Drawing Sheets

UMBRELLA WITH A ROTATABLE CANOPY

BACKGROUND OF THE INVENTION

1. Field of the Invention

This invention relates to an umbrella, more particularly to an umbrella with a canopy which is rotatable relative to a stem when subjected to a relatively strong force.

2. Description of the Related Art

Referring to FIG. 1, a conventional umbrella 1 is shown to include a stem 1, a notch member 2 secured on a top of the stem 1, a runner 3 slidably sleeved on the stem 1 to connect pivotally with a stretch assembly 4 for supporting a rib assembly 6 disposed on the underside of a canopy 5. The runner 3 is movable between an upper position for stretching the rib assembly 6 and a lower position for collapsing the same. During use, when the umbrella is subjected to a strong wind or when it accidentally comes into a forceful contact with a person or object nearby, the canopy 5, which is in a spread-out state, is likely to be twisted to result in breaking of the stretcher assembly 4 and the stem 1, and sharp tips of the rib assembly 6 may hurt those that come into therewith.

SUMMARY OF THE INVENTION

The object of the present invention is to provide an umbrella in which a canopy is forced to rotate relative to a stem upon being subjected to relatively strong force or upon a forceful contact with a person or object nearby so as to reduce risks of damage to the stem and to avoid hurting people nearby.

According to this invention, the umbrella includes an elongate stem extending along an axis, and having an upper stem end portion, and a runner sliding portion extending downwardly from the upper stem end portion along the axis. A notch member is aligned with the upper stem end portion along the axis, and has upper and lower notch end portions opposite to each other along the axis. A first coupling member has an upper secured end which is secured to the lower notch end portion, and a lower coupling end which is disposed opposite to the upper secured end along the axis. A second coupling member has a lower secured end which is secured to the upper stem end portion, and an upper coupling end which is opposite to the lower secured end along the axis and which is disposed to be swivelable and frictionally rotatable relative to the lower coupling end about the axis. A retaining member is disposed to prevent displacement of the lower coupling end relative to the upper coupling end along the axis during frictional rotation of the upper coupling end relative to the lower coupling end. A canopy is mounted on the upper notch end portion of the notch member. A rib assembly includes a plurality of ribs, each of which has a proximate rib end that is pivoted to the lower notch end portion of the notch member, and a distal rib end that extends from the proximate rib end radial to the axis and that is disposed at an underside of the canopy to support the canopy in a spread-out position and in a collapsed position. A tubular runner is slidably sleeved on the runner sliding portion of the stem, and is movable between upper and lower positions which correspond respectively to the spread-out and collapsed positions of the canopy. A stretcher assembly is disposed to interconnect the rib assembly and the runner so as to stretch or retract the rib assembly, thereby placing the canopy in the spread-out position or the collapsed position when the runner is moved to the upper position or the lower position, respectively, and thereby permitting the runner to be rotated with the lower coupling end of the first coupling member.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
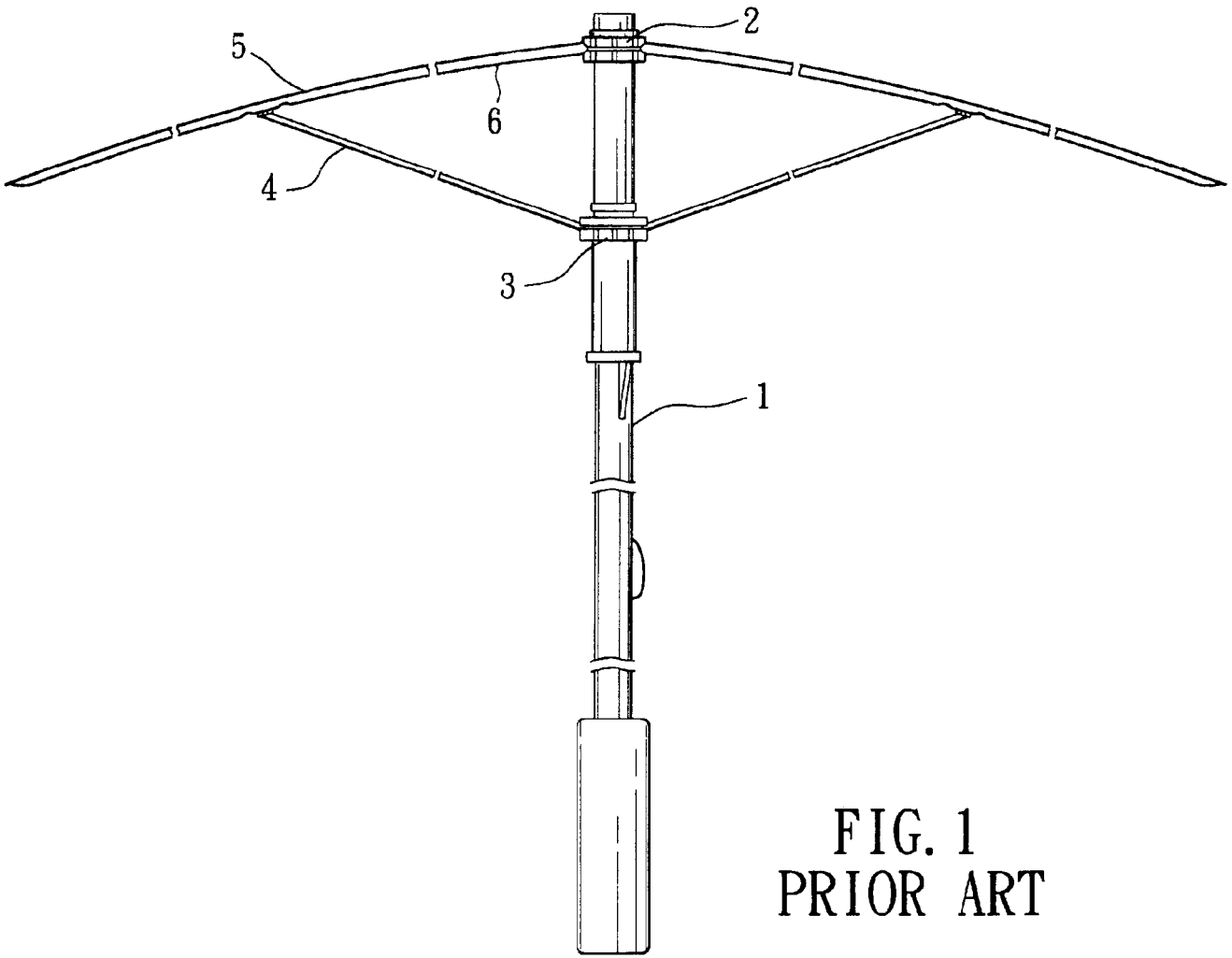
FIG. 1 PRIOR ART
FIG. 1 is a fragmentary schematic view of a conventional umbrella in a spread-out state.

Before the present invention is described in greater detail, it should be noted that same reference numerals have been used to denote like elements throughout the specification.

Figure 2:
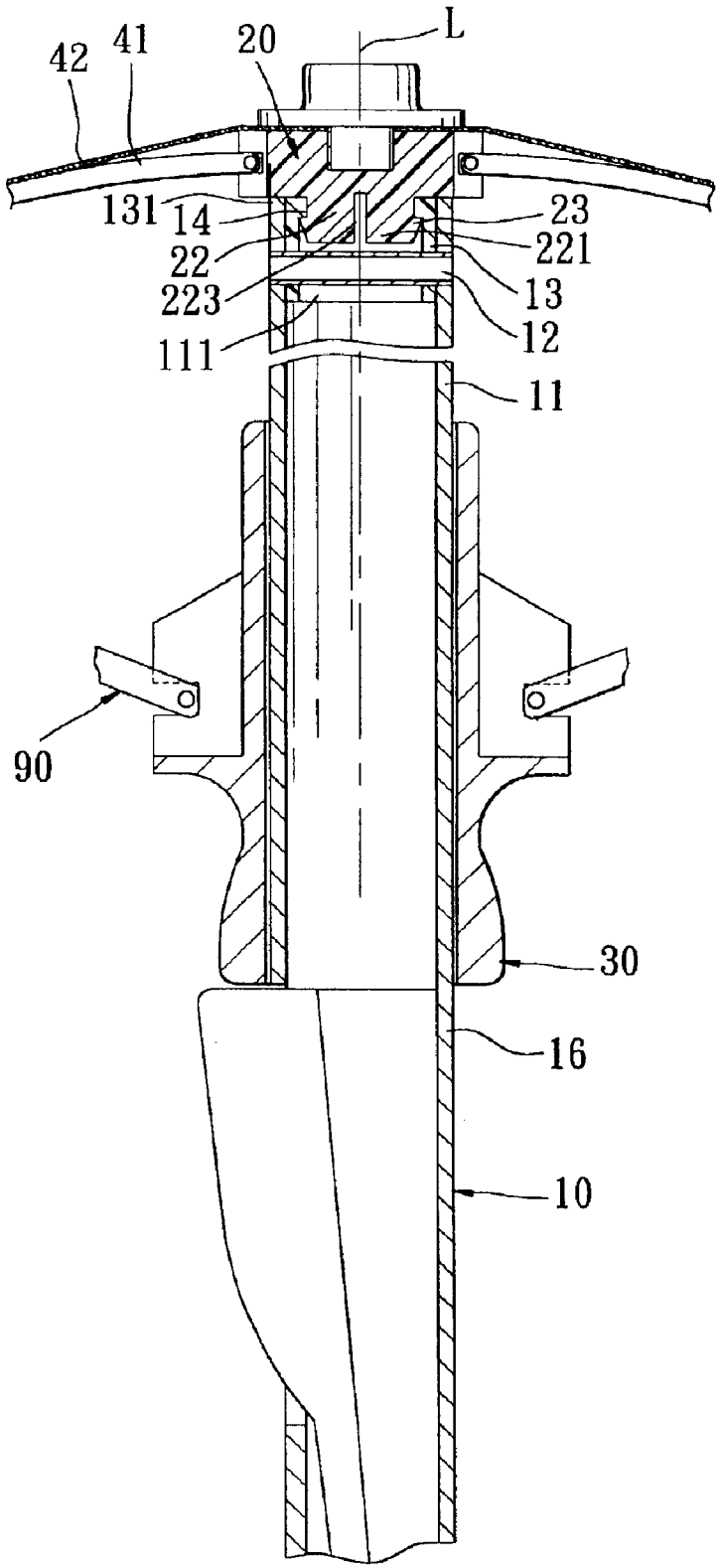
FIGS. 2 to 12 are respectively fragmentary sectional views of the first to eleventh preferred embodiments of an umbrella according to this invention.

Referring to FIG. 2, the first preferred embodiment of an umbrella according to the present invention is shown to comprise an elongate stem 10, a notch member 20, first and second coupling members 22,13, a retaining member, a canopy 42, a rib assembly 41, a tubular runner 30, and a stretcher assembly 90.

The stem 10 extends along an axis (L), and has an upper stem end portion 11 and a runner sliding portion 16 which extends downwardly from the upper stem end portion 11 along the axis (L). The upper stem end portion 11 is tubular, and has a surrounding wall surrounding the axis (L) to define a hole 111.

The notch member 20 is disposed on and is aligned with the upper stem end portion 11 along the axis (L), and has upper and lower notch end portions opposite to each other along the axis (L).

In this embodiment, the first coupling member 22 is formed integrally with the notch member 20, and is configured as a protrusion. The first coupling member 22 has an upper secured end which extends downwardly from the lower notch end portion of the notch member 20, and a lower coupling end 221 which is disposed opposite to the upper secured end along the axis (L). The retaining member includes a first retaining portion 23 which is formed integrally with and which extends radially and outwardly from the lower coupling end 221 of the first coupling member 22.

The second coupling member 13 is configured as a tube which is received in the hole 111. The second coupling member 13 has a lower secured end which is secured to the surrounding wall of the upper stem end portion 11 by a fastening pin 12 that extends through the surrounding wall and the lower secured end in a direction radial to the axis (L), and an upper coupling end 131 which is opposite to the lower secured end along the axis (L). Thus, the first coupling member 22, which is configured as the protrusion, is inserted into the second coupling member 13, which is configured as the tube, downwardly and in a longitudinal direction parallel to the axis (L) such that the lower coupling end 221 of the first coupling member 22 is swivelable and is frictionally rotatable relative to the upper coupling end 131 of the second coupling member 13 about the axis (L).

The retaining member further includes a second retaining portion 14 which is formed integrally with and which extends radially and inwardly from the upper coupling end 131 of the second coupling member 13 and which is superimposed upon the first retaining portion 23 so as to permit slidable contact therebetween during frictional rotation of the upper coupling end 131 relative to the lower coupling end 221, thereby preventing displacement of the lower coupling end 221 relative to the upper coupling end 131 along the axis (L).

Preferably, the first coupling member 22 has a slit 223 which is formed in the lower coupling end 221 so as to facilitate insertion of the first coupling member 22 into the second coupling member 13.

The canopy 42 is mounted on the upper notch end portion of the notch member 20.

The rib assembly 41 includes a plurality of ribs, each of which has a proximate rib end that is pivoted to the lower notch end portion of the notch member 20, and a distal rib end that extends from the proximate rib end radial to the axis (L) and that is disposed at an underside of the canopy 41 to support the canopy 41 in a spread-out position and in a collapsed position.

The tubular runner 30 is slidably sleeved on the runner sliding portion 16 of the stem 10, and is movable between upper and lower positions which correspond respectively to the spread-out and collapsed positions of the canopy 41.

The stretcher assembly 90 is disposed to interconnect the rib assembly 41 and the runner 30 so as to stretch or retract the rib assembly 41, thereby placing the canopy 42 in the spread-out position or the collapsed position when the runner 30 is moved to the upper position or the lower position, respectively, and thereby permitting the runner 30 to be rotated with the lower coupling end 221 of the first coupling member 22.

Since the canopy 42, the rib assembly 41, the runner 30 and the stretcher assembly 90 are similar to those in the conventional umbrella, a detailed description thereof is dispensed with herein for the sake of brevity.

When the canopy 42 of this embodiment is in the spread-out position during use, and is subjected to a relatively strong force, such as the wind or comes into a forceful contact with an object or a person, the canopy 42 is forced to rotate with the notch member 20, the first coupling member 22 and the runner 30 relative to the stem 10 about the axis (L), thereby reducing the risks of damage to the stem 10 and the rib assembly 41. As such, the service life of the umbrella can be prolonged, and injury to nearby people and objects can be avoided.

Figure 3:
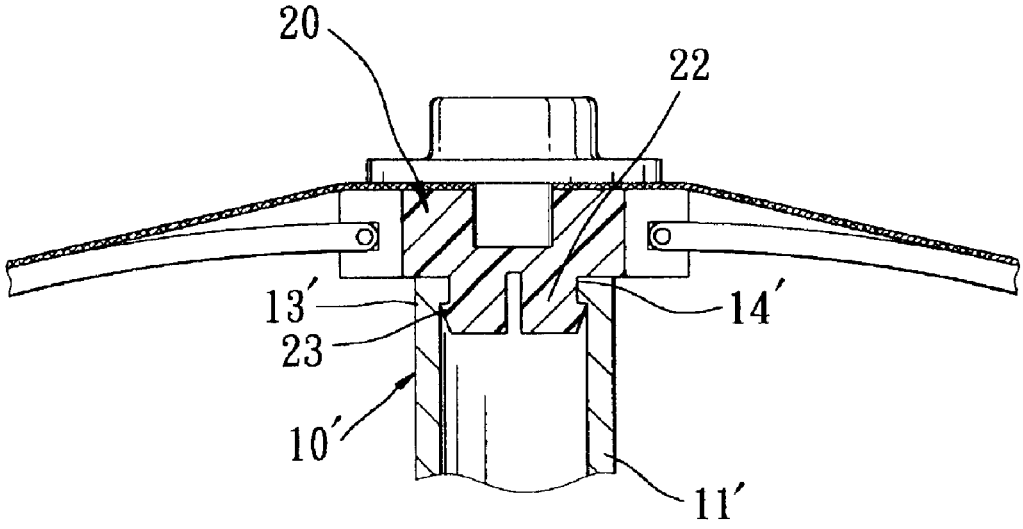

FIG. 3 shows the second preferred embodiment of an umbrella according to the present invention, which is similar to the first preferred embodiment in construction, and which is shown to comprise an elongate stem 10', a notch member 20, first and second coupling members 22,13', a retaining member with first and second retaining portions 23,14', a canopy (not shown), a rib assembly (not shown), a tubular runner (not shown) and a stretcher assembly (not shown). The difference resides in that the second coupling member 13' is formed integrally with and extends upwardly from the upper stem end portion 11' of the stem 10'. Thus, there is no need for a fastening pin to secure the second coupling member 13' to the stem 10'.

Figure 4:
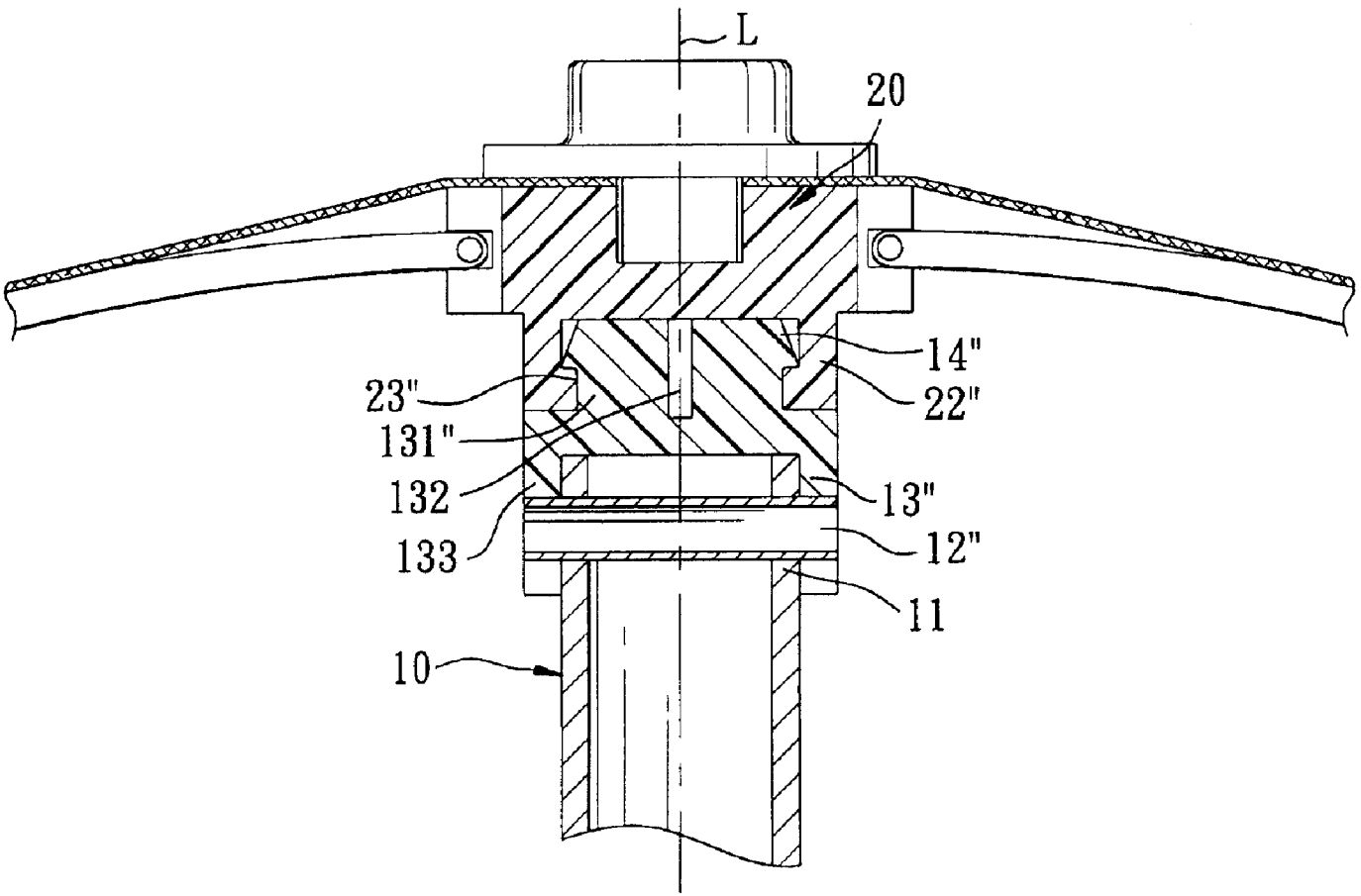

FIG. 4 shows the third preferred embodiment of an umbrella according to the present invention, which is similar to the first preferred embodiment in construction. In this embodiment, the lower coupling end of the first coupling member 22" is configured as a tube which surrounds the axis (L). The upper coupling end 131" of the second coupling member 13" is configured as a protrusion which is inserted into the tube upwardly and in the longitudinal direction to permit the first and second retaining portions 23",14" to be superimposed upon each other. Preferably, the second retaining portion 14" has a frusto-conical cross section for facilitating insertion of the protrusion into the tube. More preferably, the protrusion has a slit 132 so as to be able to be press-fitted into the tube.

In addition, the lower secured end 133 of the second coupling member 13" is secured on the upper stem end portion 11 of the stem 10 by a fastening pin 12" which extends through the lower secured end 133 and the upper stem end portion 11 in a direction radial to the axis (L).

Figure 5:
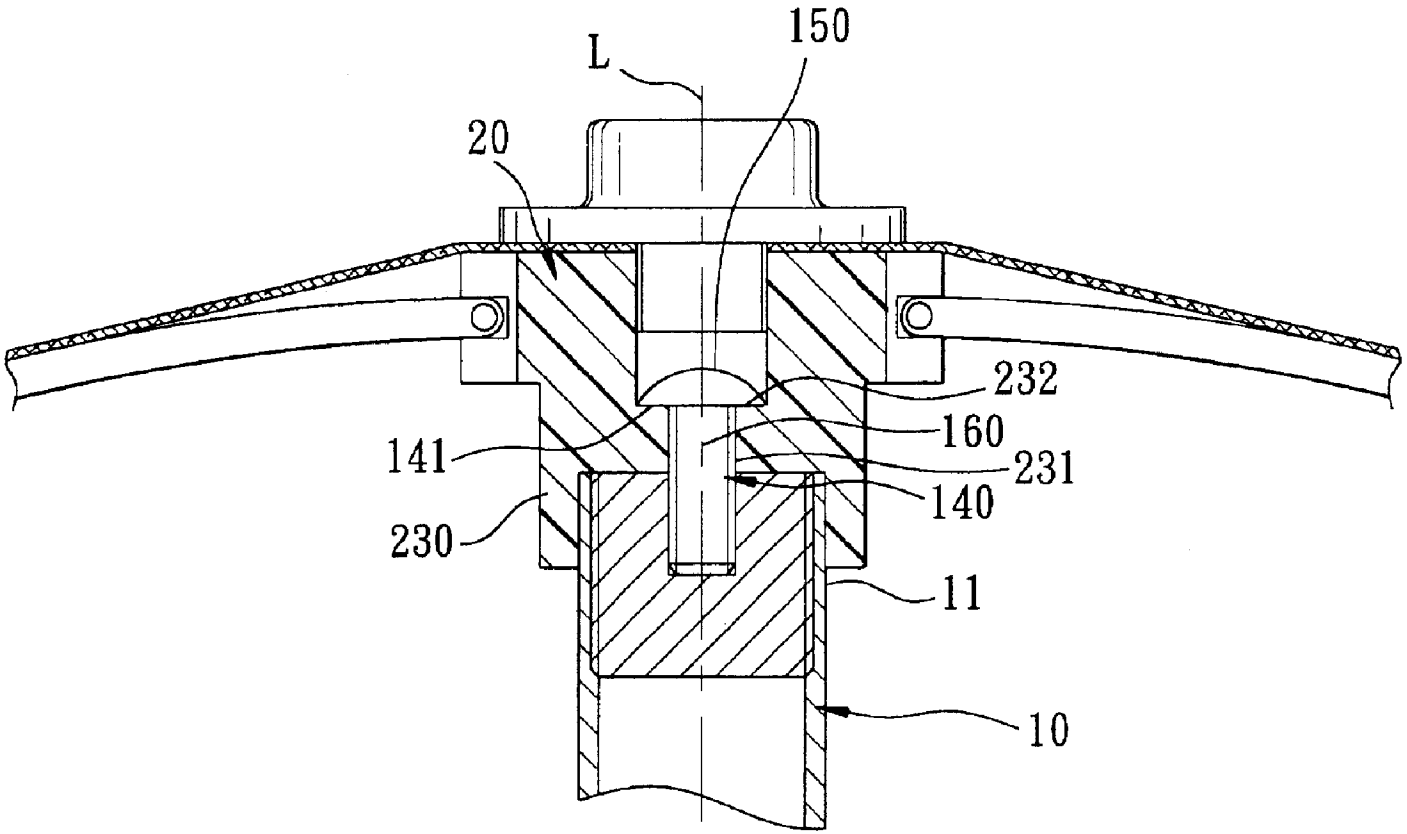

FIG. 5 shows the fourth preferred embodiment of an umbrella according to the present invention. In this embodiment, the second coupling member and the second retaining portion are configured as a screw bolt 140 which includes a threaded shank 160 that engages threadedly the upper stem end portion 11 of the stem 10 along the axis (L) and that serves as the second coupling member, and a head 150 that extends from the threaded shank 160 upwardly to be distal from the upper stem end portion 11, and that cooperates with the threaded shank 160 to define a shoulder 141 serving as the second retaining portion. The first coupling member and the first retaining portion are configured as a sleeve 230 which is formed integrally with the notch member 20. The sleeve 230 has an inner wall 231 that is sleeved on the threaded shank 160, and an upper annular edge 232 that extends radially and outwardly from the inner wall 231 and that engages frictionally the shoulder 141 so as to serve as the first retaining portion.

Figure 6:
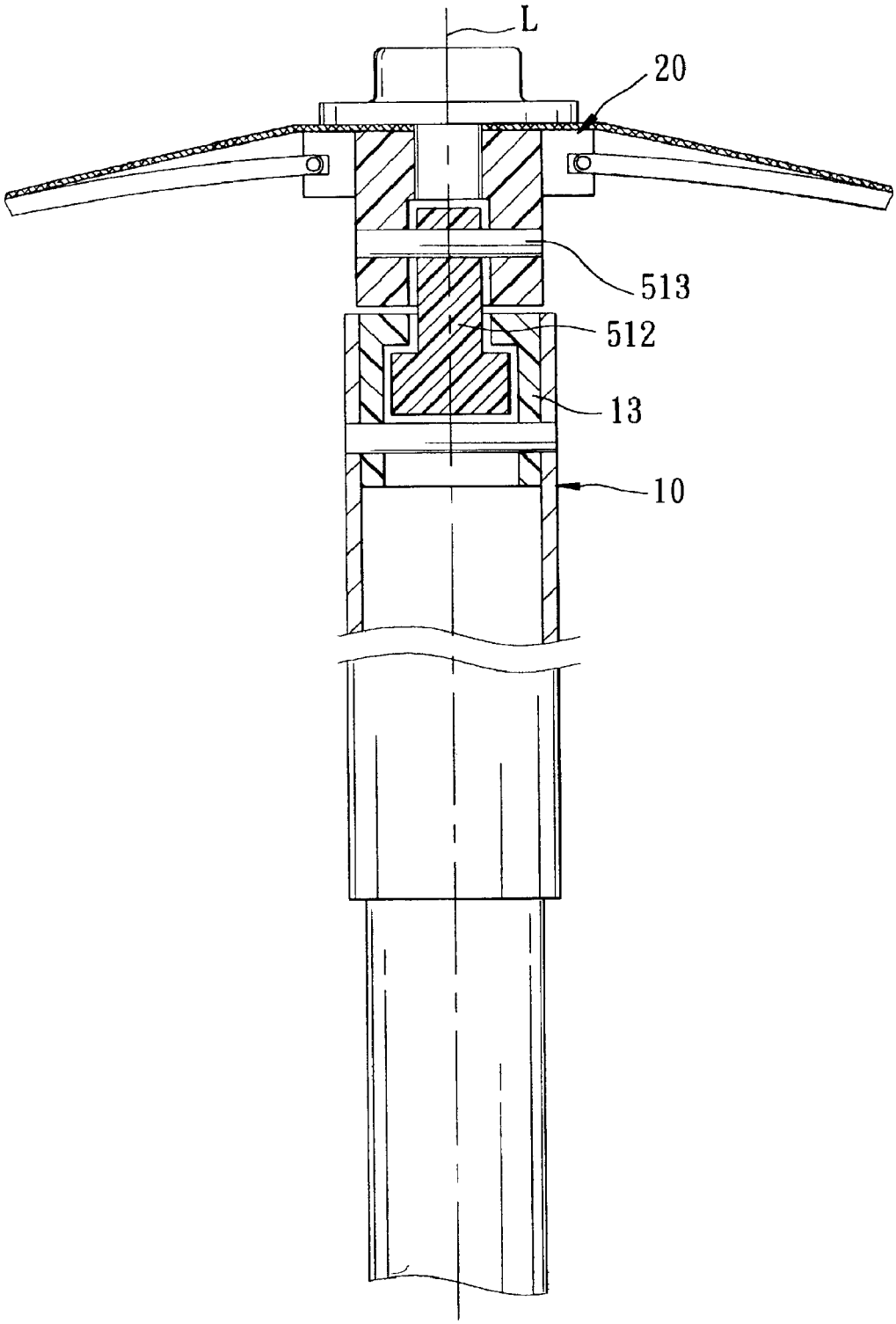

FIG. 6 shows the fifth preferred embodiment of an umbrella according to the present invention which is similar to the first preferred embodiment in construction, except that the first coupling member 512 is a separate part from the notch member 20, and is secured to the notch member 20 by a fastening pin 513 which extends therethrough in a direction radial to the axis (L).

Figure 7:
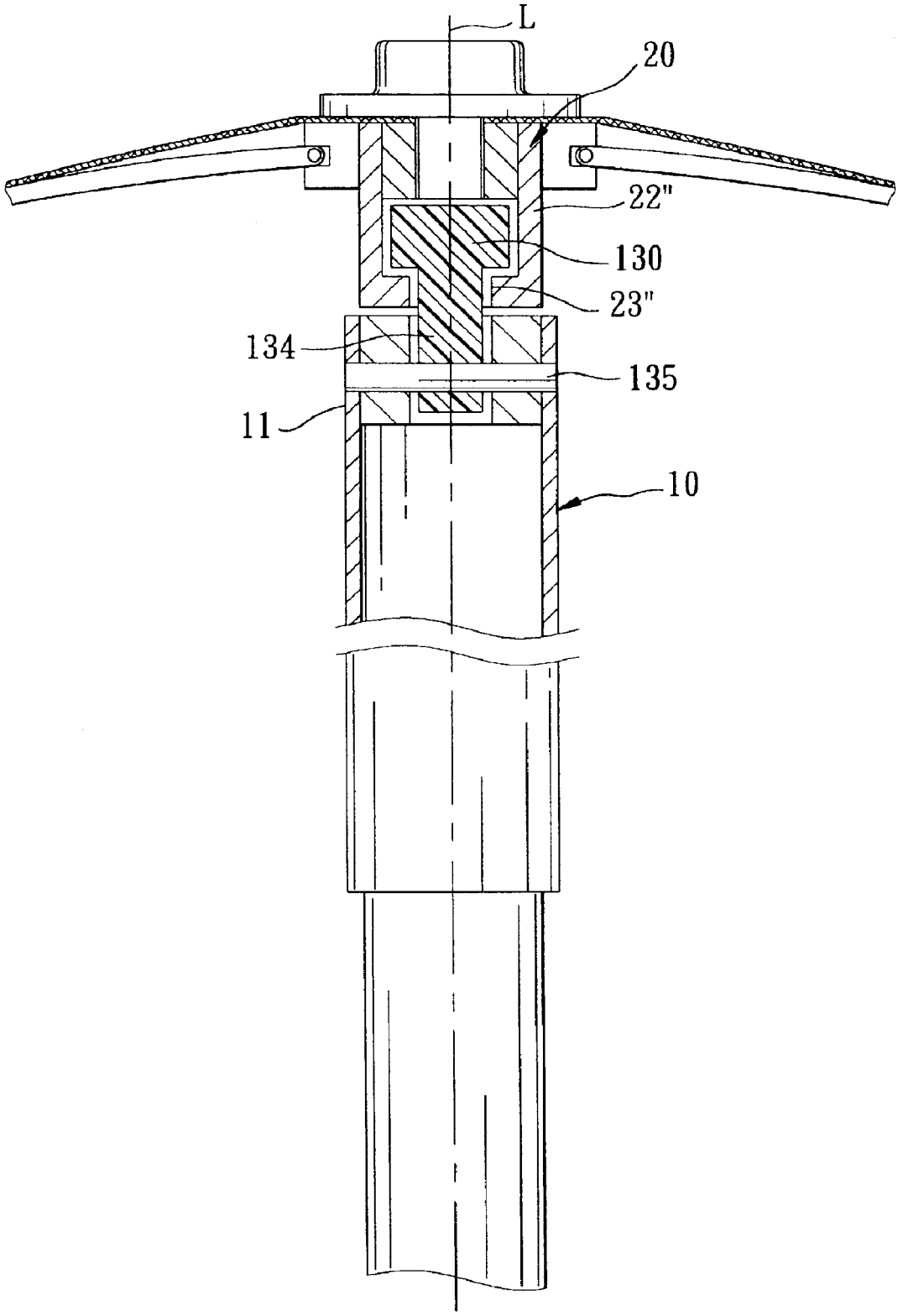

FIG. 7 shows the sixth preferred embodiment of an umbrella according to the present invention, which is similar to the third preferred embodiment in construction, except that the lower secured end 134 of the second coupling member 130 extends into the upper stem end portion 11 of the stem 10 along the axis (L), and is secured to the upper stem end portion 11 by a fastening pin 135 which extends therethrough in a direction radial to the axis (L).

Figure 8:
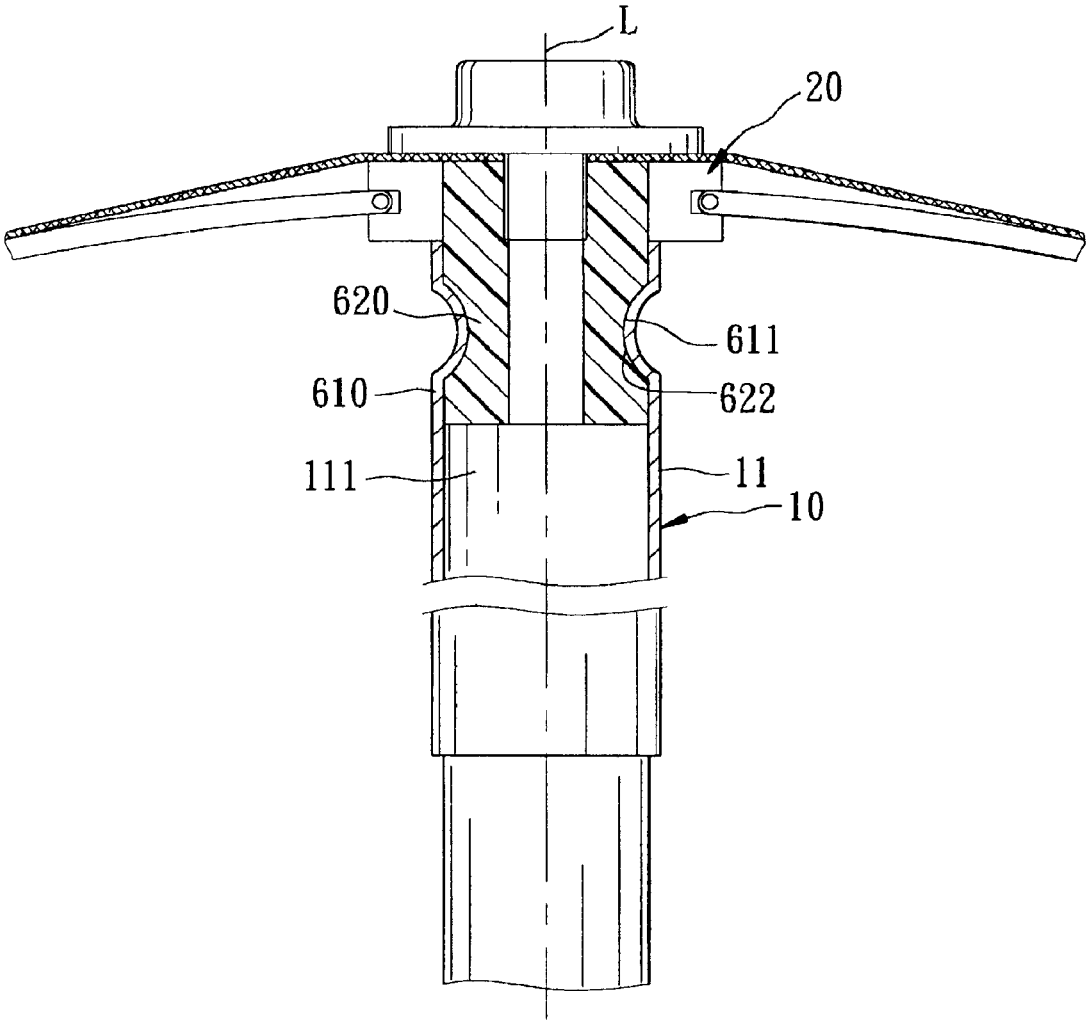

FIG. 8 shows the seventh preferred embodiment of an umbrella according to the present invention. As shown, the upper stem end portion 11 of the stem 10 has a surrounding wall surrounding the axis (L) to define a hole 111. The second coupling member 610 is formed integrally with the surrounding wall and extends upwardly from the surrounding wall along the axis (L). In this embodiment, the second coupling member 610 is punched radially and inwardly relative to the axis (L) to form an annular protrusion 611 that serves as the second retaining portion. The first coupling member 620 is inserted into the second coupling member 610 in the longitudinal direction, and is formed with an annular concave portion 622 that serves as the first retaining portion and that frictionally and rotatably engages the protrusion 611.

Figure 9:
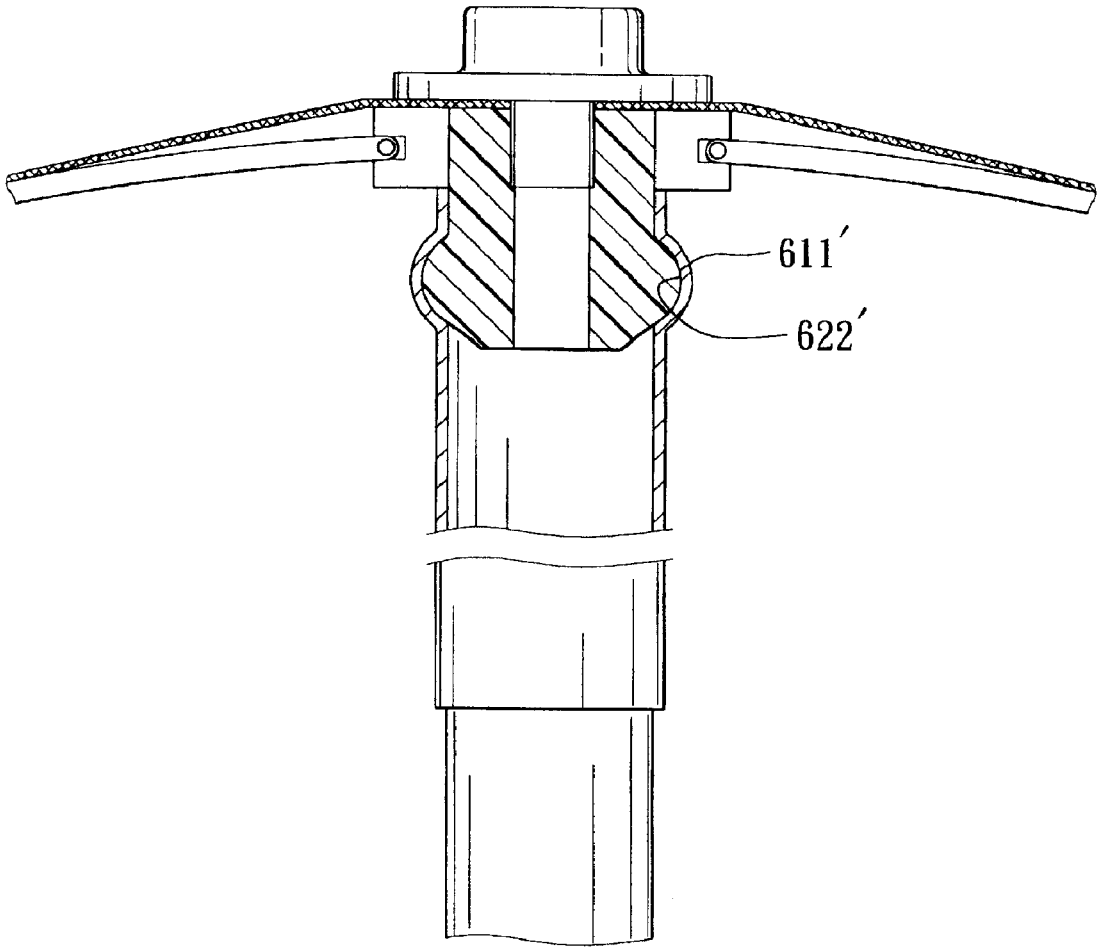

Alternatively, in the eighth preferred embodiment of an umbrella according to this invention as shown in FIG. 9, the second retaining portion 611' is curved radially and outwardly from the second coupling member, and the first retaining portion 622' projects radially and outwardly relative to the axis and mates with the second retaining portion 611' so as to frictionally and rotatably engages the second retaining portion 611'.

Figure 10:
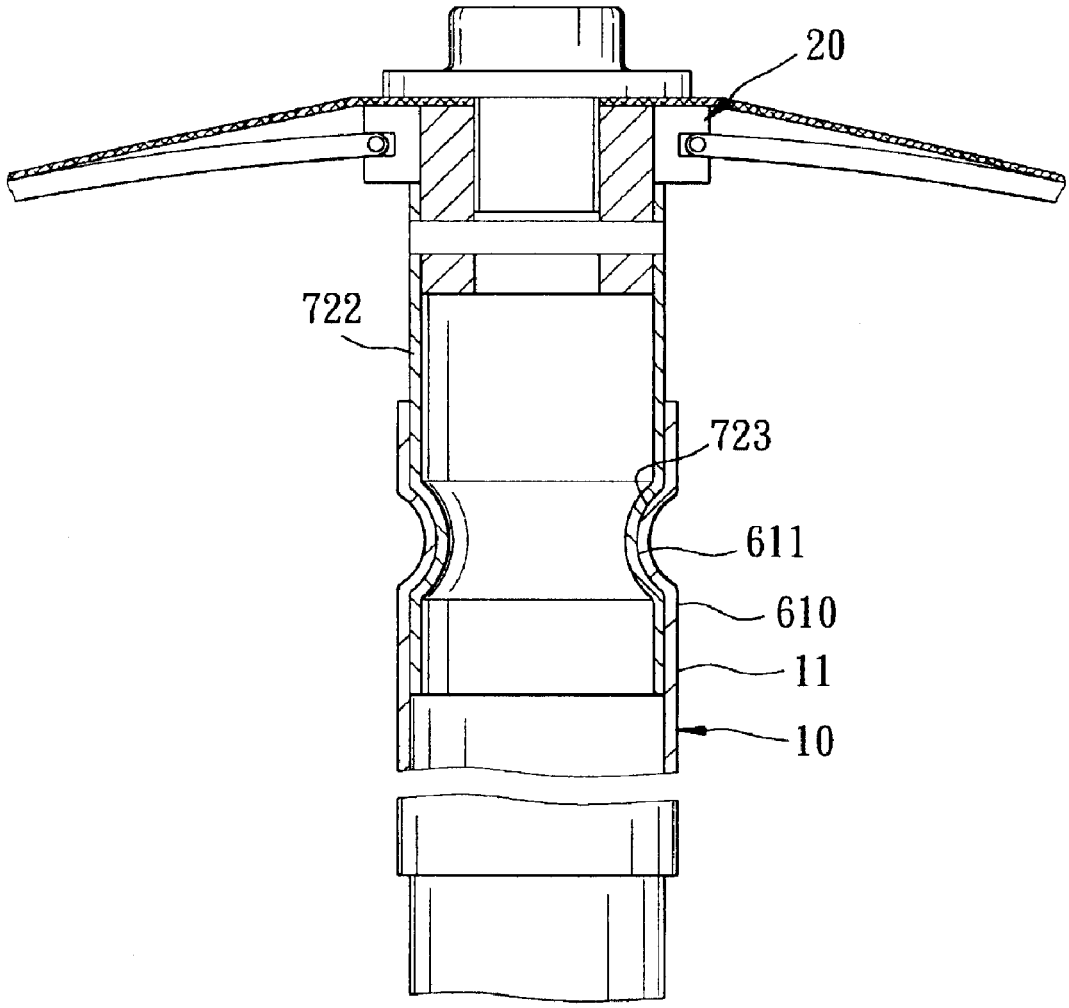

FIG. 10 shows the ninth preferred embodiment of an umbrella according to the present invention, which is similar to the seventh preferred embodiment in construction. The difference resides in that the first coupling member 722 is configured as a tube which is sleeved securely on the notch member 20 and which is formed with an annular concave portion 723 to serve as the first retaining portion.

Figure 11:
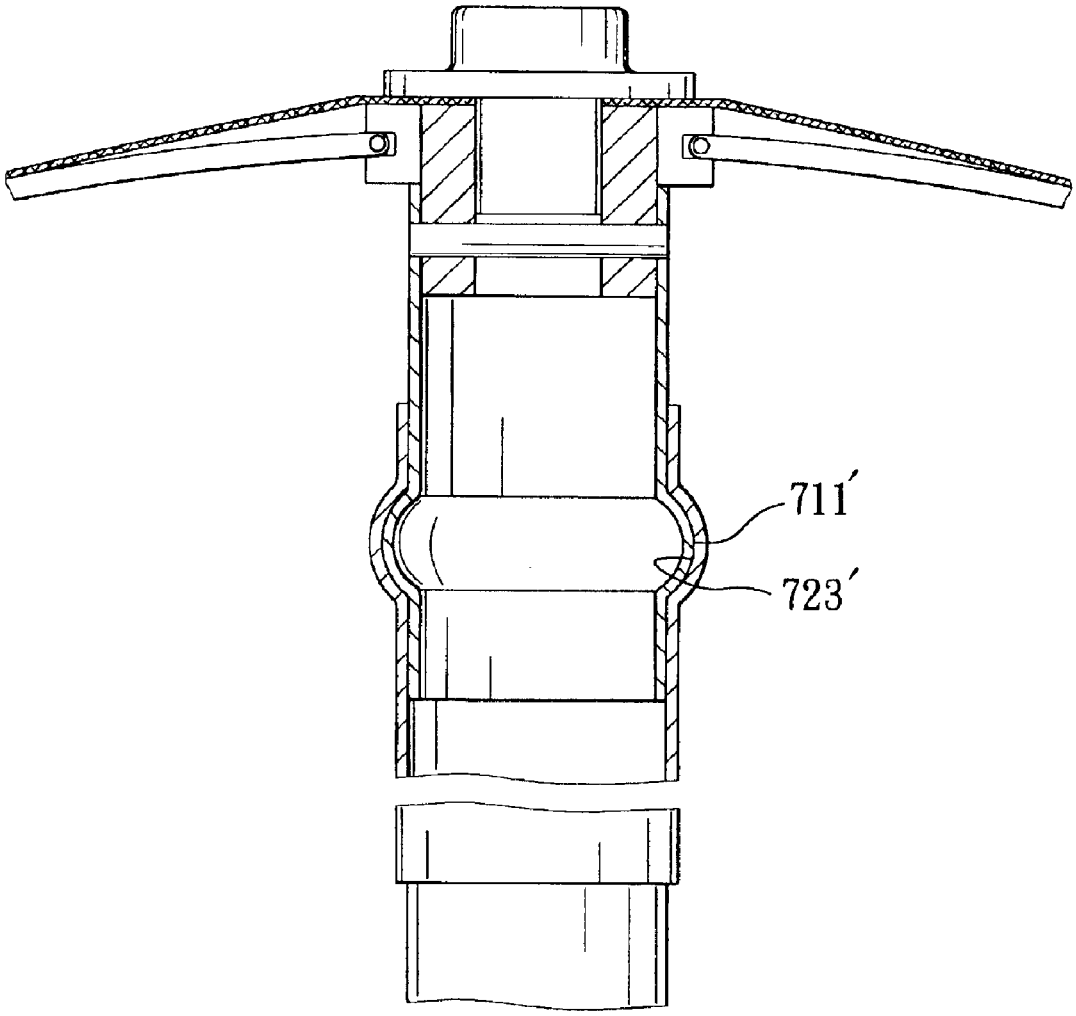

Alternatively, in the tenth preferred embodiment of an umbrella according to this invention as shown in FIG. 11, the second retaining portion 711' is curved radially and outwardly from the second coupling member, and the first retaining portion 723' projects radially and outwardly relative to the axis and mates with the second retaining portion 711' so as to frictionally and rotatably engage the second retaining portion 711'.

Figure 12:
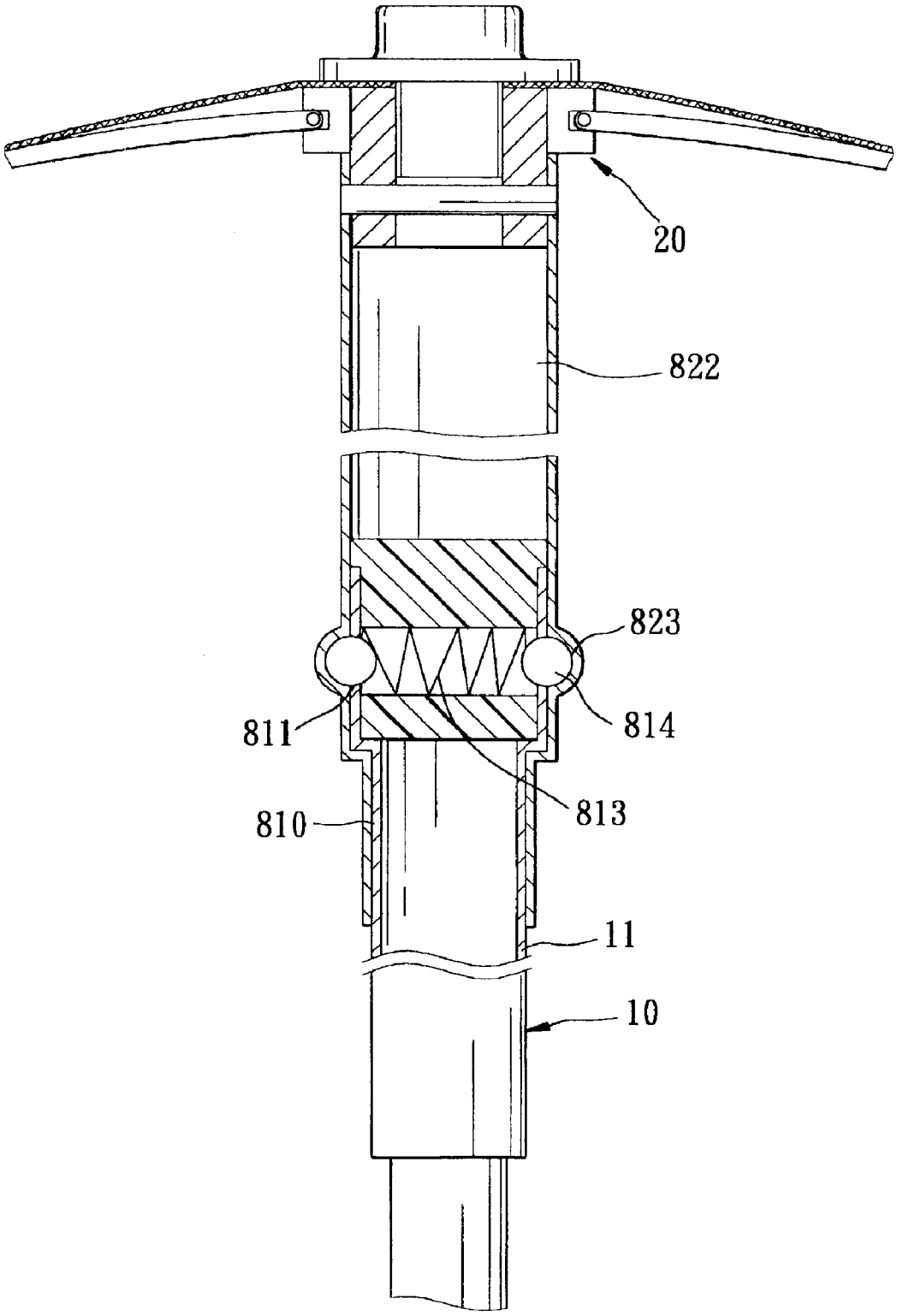

FIG. 12 shows the eleventh preferred embodiment of an umbrella according to the present invention. In this embodiment, the second coupling member 810 is configured as a tube which extends upwardly from the upper stem end portion 11 of the stem 10 along the axis, and which has two diametrically opposite through holes 811. The first coupling member 822 is configured as a sleeve which is sleeved rotatably on the tube and which has a surrounding convex portion 823 that surrounds the axis and that covers the through holes 811 to serve as the first retaining portion. The second retaining portion includes two rollers 814 which are respectively received in the through holes 811 and which rollably and frictionally engage the surrounding convex portion 823, and a spring 813 which is disposed to bias the rollers 814 towards the surrounding convex portion 823.

As illustrated, in the umbrella of this invention, since the canopy 42 can be forced to rotate with the notch member 20, the first coupling member 22 and the runner 30 relative to the stem 10,10' about the axis (L) once the canopy 42 is subjected to a force from the wind, or comes into a forceful contact with a person or an object nearby, damage to the stem 10,10' and the rib assembly 41 can be reduced to help prolong the service life of the umbrella, and possible injuries to people and objects that come into contact therewith can be avoided.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An umbrella comprising:

an elongate stem extending along an axis, and having an upper stem end portion, and a runner sliding portion extending downwardly from said upper stem end portion along the axis;

a notch member aligned with said upper stem end portion along the axis, and having upper and lower notch end portions opposite to each other along the axis;

a first coupling member having an upper secured end which is secured to said lower notch end portion, and a lower coupling end which is disposed opposite to said upper secured end along the axis;

a second coupling member having a lower secured end which is secured to said upper stem end portion, and an upper coupling end which is opposite to said lower secured end along the axis and which is disposed to be swivelable and frictionally rotatable relative to said lower coupling end about the axis, at least one of said upper secured end and said lower secured end being integrally formed with a respective one of said lower notch end portion and said upper stem end portion;

a retaining member disposed between said upper and lower secured ends along the axis so as to prevent displacement of said lower coupling end relative to said upper coupling end along the axis during frictional rotation of said upper coupling end relative to said lower coupling end;

a canopy mounted on said upper notch end portion of said notch member;

a rib assembly including a plurality of ribs, each of which has a proximate rib end that is pivoted to said lower notch end portion of said notch member, and a distal rib end that extends from said proximate rib end radial to the axis and that is disposed at an underside of said canopy to support said canopy in a spread-out position and in a collapsed position;

a tubular runner slidably sleeved on said runner sliding portion of said stem, and movable between upper and lower positions which correspond respectively to the spread-out and collapsed positions of said canopy; and a stretcher assembly disposed to interconnect said rib assembly and said runner so as to stretch or retract said rib assembly, thereby placing said canopy in the spread-out position or the collapsed position when said runner is moved to the upper position or the lower position, respectively, and thereby permitting said runner to be rotated with said lower coupling end of said first coupling member.

2. The umbrella of claim 1, wherein one of said upper and lower coupling ends is sleeved on the other one of said upper and lower coupling ends along the axis so as to be swivelable relative thereto about the axis, said retaining member including first and second retaining portions which are disposed on said lower and upper coupling ends, respectively, and which extend in a direction radial to the axis such that said first and second retaining portions are superimposed upon each other so as to permit slidable contact therebetween when said upper and lower coupling ends are forced to frictionally rotate relative to each other.

3. The umbrella of claim 2, wherein said first and second retaining portions are formed integrally with said lower and upper coupling ends, respectively, and are configured to mate with each other so as to frictionally and rotatably engage each other in a longitudinal direction parallel to the axis.

4. The umbrella of claim 3, wherein said upper stem end portion has a surrounding wall surrounding the axis to define a hole, said second coupling member being configured as a tube which is received in said hole and being secured to said surrounding wall, said first coupling member being configured as a protrusion which is inserted into said tube downwardly and in the longitudinal direction to permit said first and second retaining portions to be superimposed upon each other.

5. The umbrella of claim 4, wherein said second coupling member is formed integrally with said upper stem end portion and extends upwardly from said upper stem end portion.

6. The umbrella of claim 4, wherein said protrusion has a slit formed in said lower coupling end so as to facilitate insertion of said protrusion into said tube.

7. The umbrella of claim 4, further comprising a fastening pin extending through said first coupling member and said notch member in a direction radial to the axis so as to secure said first coupling member to said notch member.

8. The umbrella of claim 3, wherein said lower coupling end of said first coupling member is configured as a tube which surrounds the axis, said upper coupling end being configured as a protrusion which is inserted into said tube upwardly and in the longitudinal direction to permit said first and second retaining portions to be superimposed upon each other.

9. The umbrella of claim 8, wherein said protrusion has a slit so as to facilitate insertion of said protrusion into said tube.

10. The umbrella of claim 8, wherein said lower secured end of said second coupling member is sleeved on said upper stem end portion, said umbrella further comprising a fastening pin which extends through said second coupling member and said upper stem end portion in a direction radial to the axis so as to secure said second coupling member to said upper stem end portion.

11. The umbrella of claim 8, wherein said lower secured end extends into said upper stem end portion along the axis, said umbrella further comprising a fastening pin which extends through said lower secured end and said upper stem end portion in a direction radial to the axis so as to secure said lower secured end to said upper stem end portion.

12. The umbrella of claim 3, wherein said second coupling member and said second retaining portion are configured as a screw bolt which includes a threaded shank that engages threadedly said upper stem end portion along the axis and that serves as said second coupling member, and a head that extends from said threaded shank upwardly and distal from said upper stem end portion, and that cooperates with said threaded shank to define a shoulder serving as said second retaining portion, said first coupling member and said first retaining portion being configured as a sleeve which has an inner wall that is sleeved on said threaded shank, and an upper annular edge that extends radially and outwardly from said inner wall and that frictionally engages said shoulder so as to serve as said first retaining portion.

13. The umbrella of claim 3, wherein said upper stem end portion has a surrounding wall surrounding the axis to define a hole, said second coupling member being formed integrally with said surrounding wall and extending upwardly from said surrounding wall along the axis.

14. The umbrella of claim 13, wherein said second coupling member is punched radially and inwardly relative to the axis to form a protrusion that serves as said second retaining portion, said first coupling member being inserted into said second coupling member in the longitudinal direction and being formed with an annular concave portion that serves as said first retaining portion and that frictionally and rotatably engages said protrusion.

15. The umbrella of claim 2, wherein said second coupling member is configured as a tube which extends upwardly from said upper stem end portion along the axis, and which has two diametrically opposite through holes, said first coupling member being configured as a sleeve which is sleeved rotatably on said tube and which has a surrounding convex portion that surrounds the axis and that covers said through holes to serve as said first retaining portion, said second retaining portion including two rollers which are respectively received in said through holes and which rollably and frictionally engage said surrounding convex portion, and a spring which is disposed to bias said rollers towards said surrounding convex portion.

* * * * *